US009556498B2

(12) United States Patent
Horiya et al.

(10) Patent No.: US 9,556,498 B2
(45) Date of Patent: Jan. 31, 2017

(54) METHOD FOR PRODUCING SPHEROIDAL GRAPHITE CAST IRON AND VEHICLE COMPONENT USING SAID SPHEROIDAL GRAPHITE CAST IRON

(71) Applicant: AKEBONO BRAKE INDUSTRY CO., LTD., Tokyo (JP)

(72) Inventors: Takao Horiya, Tokyo (JP); Tsukasa Baba, Tokyo (JP); Takuya Tokiyama, Tokyo (JP); Takashi Sato, Tokyo (JP); Hiroshi Idei, Tokyo (JP)

(73) Assignee: AKEBONO BRAKE INDUSTRY CO., LTD., Tokyo (JP)

( * ) Notice: Subject to any disclaimer, the term of this patent is extended or adjusted under 35 U.S.C. 154(b) by 359 days.

(21) Appl. No.: 14/349,727

(22) PCT Filed: Oct. 5, 2012

(86) PCT No.: PCT/JP2012/075961
§ 371 (c)(1),
(2) Date: Apr. 4, 2014

(87) PCT Pub. No.: WO2013/051698
PCT Pub. Date: Apr. 11, 2013

(65) Prior Publication Data

US 2014/0271330 A1 Sep. 18, 2014

(30) Foreign Application Priority Data

Oct. 7, 2011 (JP) ..... 2011-223483

(51) Int. Cl.
*C22C 33/08* (2006.01)
*C22C 33/10* (2006.01)
(Continued)

(52) U.S. Cl.
CPC ..... *C21C 7/0006* (2013.01); *B22D 1/00* (2013.01); *B22D 27/00* (2013.01); *B22D 27/20* (2013.01);
(Continued)

(58) Field of Classification Search
CPC ..... C22C 33/08; C22C 33/10; C22C 37/04; C22C 37/10; C21C 1/10; C21C 1/105; C21C 2300/08; C21C 7/0006; C21D 5/00; B22D 1/00; B22D 27/00; B22D 27/20
(Continued)

(56) References Cited

U.S. PATENT DOCUMENTS 4,385,030 A * 5/1983 Dremann ..... C21C 1/105 420/578
4,396,428 A * 8/1983 Linebarger ..... C22C 33/10 420/22
(Continued)

FOREIGN PATENT DOCUMENTS

CN 101429616 A 5/2009
CN 101775532 A 7/2010
(Continued)

OTHER PUBLICATIONS

English translation of JP 09/125125; May 1997; 6 pages.*
(Continued)

*Primary Examiner* — Helene Klemanski
(74) *Attorney, Agent, or Firm* — Drinker Biddle & Reath LLP

(57) ABSTRACT

A method for producing spheroidal graphite cast iron having a specific final composition includes: subjecting a molten iron to a spheroidization treatment using a spheroidizing agent of an Fe—Si—Mg—Ca-based alloy containing no rare earth element; conducting an inoculation treatment
(Continued)

using a first Fe—Si-based inoculant; and conducting a pouring inoculation treatment with a given amount of a second Fe—Si-based inoculant containing 45-75% of Si, 1-3% of Ca, and 15 ppm or less of Ba.

4 Claims, 13 Drawing Sheets

(51) Int. Cl.

| | |
|---|---|
| ***C22C 37/04*** | (2006.01) |
| ***C22C 37/10*** | (2006.01) |
| ***C21C 7/00*** | (2006.01) |
| ***C21C 1/10*** | (2006.01) |
| ***C21D 5/00*** | (2006.01) |
| ***B22D 1/00*** | (2006.01) |
| ***B22D 27/00*** | (2006.01) |
| ***B22D 27/20*** | (2006.01) |
| ***C22C 28/00*** | (2006.01) |

(52) U.S. Cl.
CPC ..... *C21C 1/105* (2013.01); *C21D 5/00* (2013.01); *C22C 28/00* (2013.01); *C22C 33/08* (2013.01); *C22C 33/10* (2013.01); *C22C 37/04* (2013.01); *C22C 37/10* (2013.01); *C21C 2300/08* (2013.01)

(58) Field of Classification Search
USPC ..... 420/18, 25, 26; 75/569; 164/55.1
See application file for complete search history.

(56) References Cited

U.S. PATENT DOCUMENTS

| | | | | |
|---|---|---|---|---|
| 4,459,154 | A * | 7/1984 | Wells, III | C22C 33/10 420/27 |
| 4,545,817 | A * | 10/1985 | Bilek | C22C 33/10 420/25 |
| 4,838,956 | A * | 6/1989 | Satou | C21D 5/00 148/544 |
| 6,102,983 | A * | 8/2000 | Skaland | C21C 1/10 420/33 |
| 6,613,119 | B2 * | 9/2003 | Margaria | C21C 1/105 75/228 |
| 2003/0051776 | A1 * | 3/2003 | Enya | C22C 37/10 420/26 |
| 2005/0050992 | A1 * | 3/2005 | Loper, Jr. | C22C 33/10 75/305 |
| 2007/0134149 | A1 | 6/2007 | Koike et al. | |
| 2007/0272387 | A1 | 11/2007 | Hirukawa et al. | |
| 2014/0348694 | A1 * | 11/2014 | Baba | C21C 1/10 420/26 |

FOREIGN PATENT DOCUMENTS

| | | | |
|---|---|---|---|
| EP | 2468903 | A1 * | 6/2012 |
| JP | 59/043844 | * | 3/1984 |
| JP | S61-223116 | A | 10/1986 |
| JP | H01-329823 | A | 11/1992 |
| JP | H08-333650 | A | 12/1996 |
| JP | H09-125125 | A | 5/1997 |
| JP | H10-237528 | A | 9/1998 |
| JP | 2000-303113 | A | 10/2000 |
| JP | 2006-175494 | A | 7/2006 |
| JP | 2007-182620 | A | 7/2007 |
| WO | WO 2006-067991 | A | 6/2006 |

OTHER PUBLICATIONS

English translation of JP 2000/303113; Oct. 2000; 9 pages.*
English translation of JP 59/043844; Mar. 1984; 6 pages.*
English translation of CN 101775532; Jul. 2010; 10 pages.*
English translation of the Written Opinion of the International Search Report mailed Dec. 12, 2012 for PCT/JP2012/075961; 4 pages.*
Office Action dated Dec. 2, 2014 from corresponding Chinese patent application No. 201280049531.9 (with attached English-language translation).
Office Action issued Oct. 24, 2016 in European Patent Application No. 12 838 564.8.

* cited by examiner

A: FRACTURE SURFACE OF CHILL TEST SPECIMEN (a)

(b)

X: NO RARE EARTH + INOCULATION
Y: NO RARE EARTH + NO INOCULATION
Z: RARE EARTH + INOCULATION

METHOD FOR PRODUCING SPHEROIDAL GRAPHITE CAST IRON AND VEHICLE COMPONENT USING SAID SPHEROIDAL GRAPHITE CAST IRON

TECHNICAL FIELD

The present invention relates to a method for producing spheroidal graphite cast iron for use in products having a thin-wall part and further relates to a vehicle component which uses the spheroidal graphite cast iron and has a thin-wall part.

BACKGROUND ART

Spheroidal graphite cast iron is in wide use in recent years as components for vehicles including motor vehicles, machine parts, etc., because the spheroidal graphite cast iron has excellent tensile strength and ductility. In particular, spheroidal graphite cast iron is used in brake calipers which are important as safety components for vehicles such as motor vehicles in order to ensure the quality thereof.

Since there is a desire for weight reduction in these products, spheroidal graphite cast iron also is required to be reduced in thickness. In the case where spheroidal graphite cast iron is applied as a cast metal having a thin-wall part, a cooling rate is increased in the thin-wall part thereof and this results in the formation of a chill phase (abnormal structure). Since this chill phase has an exceedingly hard structure, the machinability is reduced and machining is difficult to be performed especially when a surface layer thereof having an enhanced tendency to chill phase formation has hardened.

Because of this, in the case of using spheroidal graphite cast iron to produce a product having a thin-wall part, the cast molten iron is usually subjected to a spheroidization treatment and further subjected to an inoculation treatment multiple times in order to inhibit chill phase formation. In particular, since the spheroidal graphite cast iron for use in components for motor vehicles is frequently required to be inhibited from having a chill structure and to retain a high level of balance between strength and ductility, various measures are being taken in producing thin-wall spheroidal graphite cast iron.

For example, a spheroidizing agent containing a rare-earth element (rare earth) is used in order to more reliably conduct spheroidization and graphitization. Patent Documents 1 to 3 disclose the spheroidizing agents containing a rare earth in a given amount (in the range of about 0.5 to 9% by mass) and the spheroidal graphite cast iron produced using the spheroidizing agents. Rare earths not only have the effect of accelerating graphite spheroidization on the basis of both a deoxidizing and desulfurizing function and the function of lowering the action of spheroidization-inhibitory elements but also serve, for example, to accelerate graphitization, prevent chill phase formation, inhibit chunky graphite formation, and inhibit fading, on the basis of the effect of yielding graphite nuclei, etc. Hence, rare earths are elements exceedingly profitable for spheroidal graphite cast iron. Especially in the production of thin-wall spheroidal graphite cast iron for use in components for motor vehicles, use of a spheroidizing agent containing such a rare earth is regarded as essential for preventing chill phase formation in the thin-wall part.

However, rare earths are resources which localize in limited regions on earth, and specific countries have exceedingly high shares of the international production thereof.

Ninety percents of the demand thereof in Japan also depend on imports from the specific countries. In recent years, rare earths have become indispensable resources not only in the field of cast metal but also in the fields of electronic appliances, magnetic components, glass appliances, catalysts, etc., and the prices thereof are skyrocketing. It is thought that the prices and production amounts thereof fluctuate considerably in the future, depending on the circumstances of the producing countries, and there is a high possibility that both the prices and the supply amounts might become exceedingly unstable.

Consequently, an imminent subject is to establish a method for producing spheroidal graphite cast iron using a spheroidizing agent which has a reduced rare-earth content or contains no rare earth, in order to ensure production amounts and quality of vehicle components using the spheroidal graphite cast iron.

There have hitherto been spheroidizing agents containing no rare earth. For example, Patent Document 4 discloses a spheroidization treatment using an Mg-based spheroidizing agent which contains no rare earth at all, from the standpoint of preventing chunky graphite from crystallizing out when large thick spheroidal graphite cast iron is produced.

PRIOR-ART DOCUMENTS

Patent Documents

Patent Document 1: JP-A-10-237528
Patent Document 2: JP-A-2000-303113
Patent Document 3: JP-A-2007-182620
Patent Document 4: JP-A-9-125125

SUMMARY OF THE INVENTION

Problem that the Invention is to Solve

However, the technique in Patent Document 4 which relates to a spheroidizing agent containing no rare earth is intended to be used only for large thick products having a thickness of 80 mm or larger, and the chill phase formation in thin-wall parts which is problematic in the production of small thick products, e.g., brake calipers for vehicles, is not taken into account at all therein. Under the current circumstances, use of a spheroidizing agent which contains a rare earth is regarded as essential for inhibiting chill phase formation in such thin-wall parts as stated above.

The present invention has been achieved in view of such current circumstances. An object thereof is to provide spheroidal graphite cast iron in which chill phase formation in the thin-wall part is inhibited even when a spheroidizing agent containing no rare earth is used and which has a high level of properties including a balance between tensile strength and ductility, rigidity, degree of spheroidization, machinability, etc., and is applicable to vehicle components required to have high quality, such as brake calipers for vehicles.

Means for Solving the Problem

The present invention relates to a method for producing spheroidal graphite cast iron which contains substantially no rare-earth element. The present inventors have found that spheroidal graphite cast iron showing excellent properties is obtained by subjecting, in a ladle, a molten iron to a spheroidization treatment using a spheroidizing agent of an Fe—Si—Mg-based ally containing no rare earth element or Fe—Si—Mg—Ca-based alloy containing no rare earth element and an inoculation treatment using a first Fe—Si-based inoculant and then conducting a pouring inoculation treatment using a second Fe—Si-based inoculant, before the molten iron is cast into a casting mold. The present invention has been thus completed.

Namely, the present invention relates to the following (1) to (3).

(1) A method for producing spheroidal graphite cast iron containing substantially no rare-earth element, the method comprising:

(a) a step of subjecting, in a ladle, a molten iron to a spheroidization treatment using a spheroidizing agent of an Fe—Si—Mg-based alloy containing no rare-earth element or Fe—Si—Mg—Ca-based alloy containing no rare-earth element;

(b) a step of conducting an inoculation treatment using a first Fe—Si-based inoculant, either simultaneously with the step (a) or after the step (a); and (c) a step of adding a second Fe—Si-based inoculant to the molten iron in an amount of 0.20 to 0.40% in terms of % by mass after the step (b) to conduct a pouring inoculation treatment, the second Fe—Si-based inoculant containing, in terms of % by mass, 45 to 75% of Si, 1 to 3% of Ca, and 15 ppm or less of Ba, wherein the spheroidal graphite cast iron to be obtained has a composition which contains, in terms of % by mass, 3.0 to 4.5% of C, 3.0 to 4.5% of Si, 0.2 to 0.4% of Mn, 0.006 to 0.020% of S, 0.08 to 0.30% of Cu, 0.020 to 0.040% of Sn, and 0.015 to 0.050% of Mg, with the remainder being Fe and unavoidable impurities.

(2) The method for producing spheroidal graphite cast iron according to (1), wherein the molten iron has a composition which contains, in terms of % by mass, 3.0 to 4.5% of C, 2.0 to 3.0% of Si, 0.2 to 0.4 of Mn, 0.006 to 0.020% of S, 0.08 to 0.30% of Cu, and 0.020 to 0.040% of Sn, with the remainder being Fe and unavoidable impurities.

(3) A vehicle component comprising spheroidal graphite cast iron obtained by the production method according to (1) or (2), the vehicle component having a degree of graphite spheroidization of 80% or higher, a tensile strength of 450 MPa or higher, and an elongation of 12% or higher, wherein a chill area rate is 1% or less in a thin-wall part in which the vehicle component comprising the spheroidal graphite cast iron has a thickness of 6 mm or less.

Effects of the Invention

The spheroidal graphite cast iron according to the present invention not only is inexpensive and capable of being stably supplied because the spheroidal graphite cast iron is produced using a spheroidizing agent containing no rare earth, but also is equal or superior to conventional spheroidal graphite cast iron in profitability, strength/ductility balance, rigidity, machinability, and casting property. Consequently, the spheroidal graphite cast iron according to the present invention is suitable for use in producing small components for vehicles, in particular, brake calipers, which has thin-wall and is important safety components.

Furthermore, the present invention can be extensively applied also to products using thin-wall spheroidal graphite cast iron which are always required to be stably supplied, such as other components for vehicles and machine parts for general industrial applications. The present invention is of great industrial significance.

BRIEF DESCRIPTION OF THE DRAWINGS

FIG. 2(*a*) is a diagrammatic view illustrating a mold for the wedge-shaped chill test specimen; and FIG. 2(*b*) is a diagrammatic perspective view of a fracture surface of the wedge-shaped chill test specimen.

FIG. 3(*a*) shows a relationship between the amount of Mn added to the molten iron and tensile strength; and FIG. 3(*b*) shows a relationship between the amount of Mn added to the molten iron and chill depth.

FIG. 4(*a*) shows a relationship between the amount of Cu added to the molten iron and tensile strength; and FIG. 4(*b*) shows a relationship between the amount of Sn added to the molten iron and tensile strength.

FIG. 5(*a*) shows a relationship between the amount of Cu added to the molten iron and elongation; and FIG. 5(*b*) shows a relationship between the amount of Sn added to the molten iron and elongation.

FIG. 6(*a*) shows a relationship between the amount of Cu added to the molten iron and the degree of graphite spheroidization; and FIG. 6(*b*) shows a relationship between the amount of Sn added to the molten iron and the degree of graphite spheroidization.

FIG. 7(*a*) shows a relationship between the amount of S added to the molten iron and chill depth; and FIG. 7(*b*) shows a relationship between the amount of S added to the molten iron and the degree of graphite spheroidization.

FIG. 8(*a*) shows a relationship between the content of Mg in the spheroidizing agent and chill depth; and FIG. 8(*b*) shows a relationship between the content of Mg in the spheroidizing agent and the degree of graphite spheroidization.

FIG. 10(*a*) shows a relationship between the content of Ba in the pouring inoculant and tensile strength; FIG. 10(*b*) shows a relationship between the content of Ba in the pouring inoculant and chill depth; and FIG. 10(*c*) shows a relationship between the content of Ba in the pouring inoculant and the degree of graphite spheroidization.

FIG. 11(*a*) shows a relationship between the addition amount of the pouring inoculant and chill depth; FIG. 11(*b*) shows a relationship between the addition amount of the pouring inoculant and elongation; and FIG. 11(*c*) shows a relationship between the addition amount of the pouring inoculant and the degree of graphite spheroidization.

FIG. 12(*a*) shows a relationship between fading time and the degree of graphite spheroidization; and FIG. 12(*b*) shows a relationship between fading time and the number of graphite grains.

FIG. 13(*a*) shows a relationship between the degree of graphite spheroidization and Young's modulus; and FIG. 13(*b*) shows a relationship between the degree of graphite spheroidization and tensile strength.

MODES FOR CARRYING OUT THE INVENTION

Figure 1:
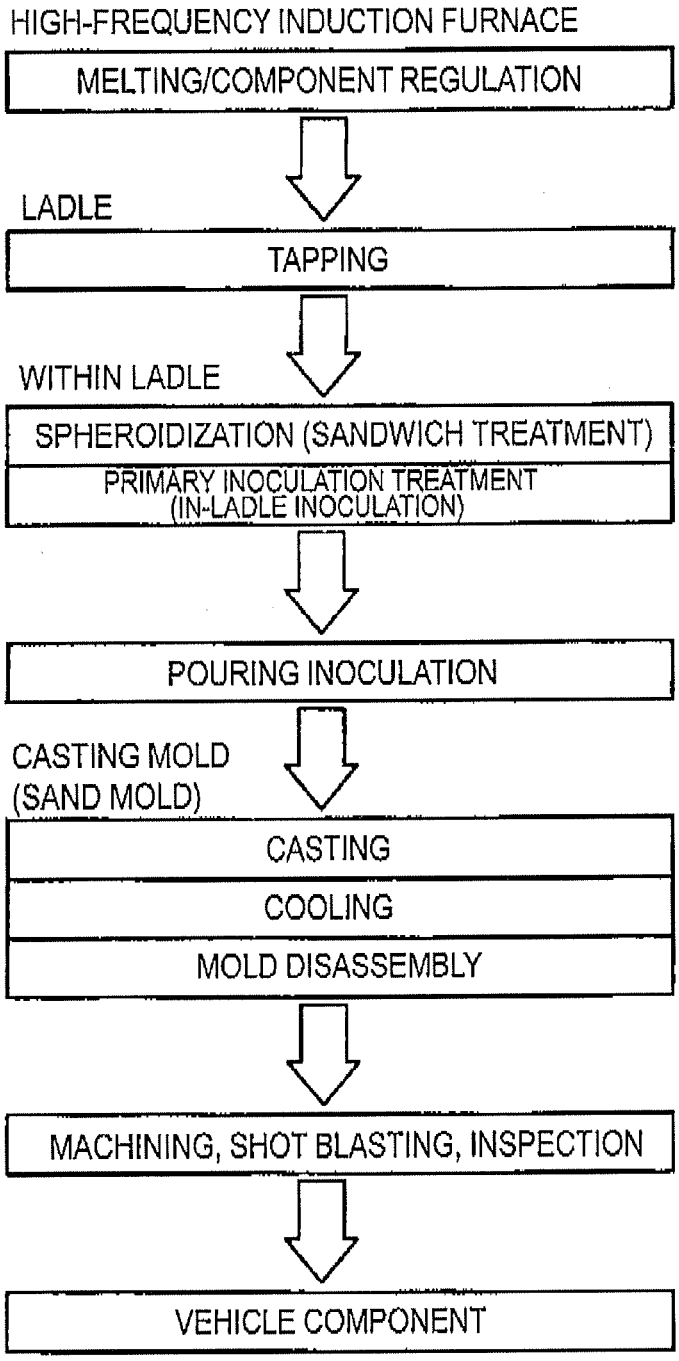
FIG. 1 is a diagrammatic flowchart which shows steps beginning with melting of raw materials and ending with completion of a component for vehicles.

The present invention is explained below in detail. Here, "% by weight" has the same meaning as "% by mass", and the mere expression "%" means "% by weight".

In the case where the content of a rare earth in a spheroidizing agent for obtaining spheroidal graphite cast iron having a thin-wall part has been reduced or the rare earth has been eliminated from the spheroidizing agent, examples of problems concerning the properties of the product include:

(1) formation of a chill phase (abnormal structure) and a decrease in machinability due to an increase in the tendency to chill phase formation;

(2) a decrease in the degree of graphite spheroidization (hereinafter referred to as degree of spheroidization) and resultant decreases in strength, ductility, and rigidity;

(3) enhanced tendency to chill phase formation due to fading; and (4) an increase in the formation of shrinkage cavities and internal defects. Here, the chill phase is a structure formed by rapid cooling during the solidification of a molten iron in producing, for example, spheroidal graphite cast iron. The carbon in this structure has been crystallized out in the form of not graphite but cementite ($Fe_3C$), and the fracture surfaces of this structure are white. The fading is a phenomenon in which an element that was added for the purpose of spheroidization treatment or inoculation treatment is consumed by oxidation or by reaction with other elements with the lapse of time and is diminished thereby and the spheroidization or inoculation does not proceed with the lapse of time. In the case where these problems have arose, the properties of the components using spheroidal graphite cast iron having a thin-wall part are considerably affected. In particular, decreases in tensile strength, ductility, and rigidity, an increase in the amount of internal defects, etc. result.

The term "thin-wall part" in this description means a part having a thickness of 6 mm or less. Spheroidal graphite cast iron having a thin-wall part can be produced in accordance with the shape of a casting mold for use in producing the spheroidal graphite cast iron.

With respect to the vehicle component including the spheroidal graphite cast iron according to the present invention, that portion of the vehicle component including the spheroidal graphite cast iron which has a thickness of 6 mm or less is referred to as the thin-wall part of the component.

Meanwhile, many proposals have hitherto been made on components of molten iron, chemical components of additives (spheroidization or inoculation) and addition amounts thereof and addition methods therefor, design of casting molds, methods for heat treatment after casting, etc., as means for overcoming the problems (1) to (4), However, most of these measures lead to an increase in cost, and are unable to sufficiently bring about the merit in profitability due to the reduction in rare-earth content.

The present inventors have diligently made investigations and, as a result, thought that for overcoming the problems (1) to (4), it is necessary to accurately control the components of the molten iron, the components of a spheroidizing agent and of an inoculant, and the addition amounts thereof. The present inventors systematically investigated influences of those factors in detail using compact casting equipment. The investigations are shown below in detail.

First, the present inventors melted the same scrap iron as in a mass-production line using a compact high-frequency induction furnace to prepare a molten iron corresponding to the standard FCD450 (JIS G 5502). The content of Mn as a main element, the addition amounts of Cu and Sn as additive elements, and the content of S as an impurity were changed to investigate influences on each property. Furthermore, a graphite spheroidization treatment by a sandwich method was conducted in a ladle under conditions according to the actual line, and not only the addition amount of a spheroidizing agent but also the contents of Mg, Ca, and Ba in the spheroidizing agent were changed. In this operation, a primary inoculation treatment with a commercial Fe—Si-based inoculant was simultaneously conducted in the ladle. An Fe—Si-based covering material was placed on the spheroidizing agent and inoculant disposed in the pocket at the bottom of the ladle, in the same manner as in actual apparatus, to completely cover the spheroidizing agent and the inoculant. Moreover, the present inventors manually performed pouring inoculation (melt-pouring inoculation) in which an inoculant was added to the molten iron just before the molten iron was cast into a casting mold (shell mold), and influences of inoculant addition amounts and of the contents of Si, Ca, Ba, etc. in the inoculant were investigated.

Basic steps were conducted in accordance with the flowchart shown in FIG. 1, As casting molds, use was made of a wedge-shaped chill test specimen and a knock-off (Kb) type test specimen (diameter, 25 mm). Furthermore, the present inventors produced test specimens while changing the period from spheroidization treatment to casting up to 15 minutes at the most and determined properties thereof, in order to evaluate the effect of fading during mass production.

Figure 2:
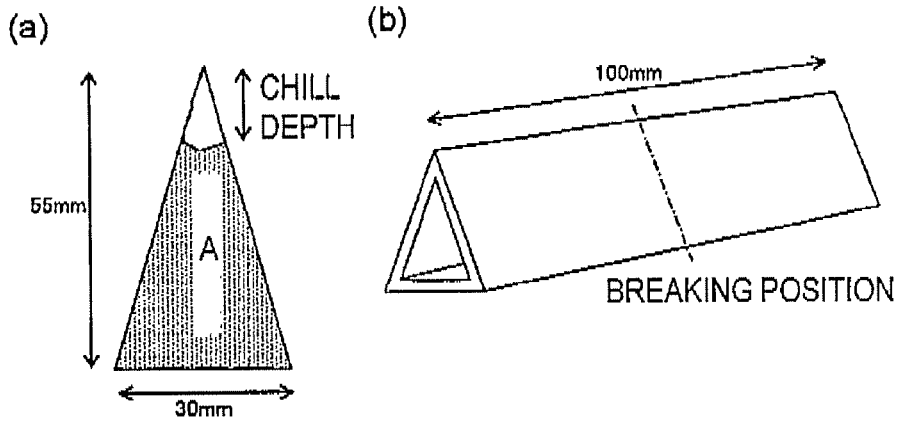
FIG. 2(*a*) and FIG. 2(*b*) are views which illustrate a wedge-shaped chill test specimen used in a preliminary test according to the present invention.

With respect to the chill test specimens, each wedge-shaped test specimen was broken at ordinary temperature, and the depth of the area which ranged from the tip of the fracture surface and the part in which a chill phase was present (chill depth) was measured with a digital scope (see FIG. 2(*a*) and FIG. 2(*b*)). The smaller the chill depth was, the more the tendency to chill phase formation was inhibited. Meanwhile, the degree of spheroidization, the number of graphite grains, etc. were determined by cutting an end (diameter, 25 mm) of the round knock-off (Kb) type rod specimen and examining a central part thereof with an optical microscope. Tensile properties were determined by examining two JIS No. 4 test specimens cut out of the round rod having a diameter of 25 mm.

As a result of this preliminary test, it was found that all the problems including chill phase formation, a reduced degree of spheroidization, and enhanced tendency to chill phase formation due to fading in as-cast material of the thin-wall spheroidal graphite cast iron can be overcome even in the case of using a spheroidizing agent containing no rare earth, by accurately controlling the amounts of Cu, Sn, and S to be added to the molten iron, the content of Mg in a spheroidizing agent, the contents of Ca and Ba in a pouring inoculant, and the addition amount thereof.

The results of the preliminary test are described below in detail while referring to drawings.

[Influences of Mn, Cu, Sn, and S on Molten Iron]

Figure 3:
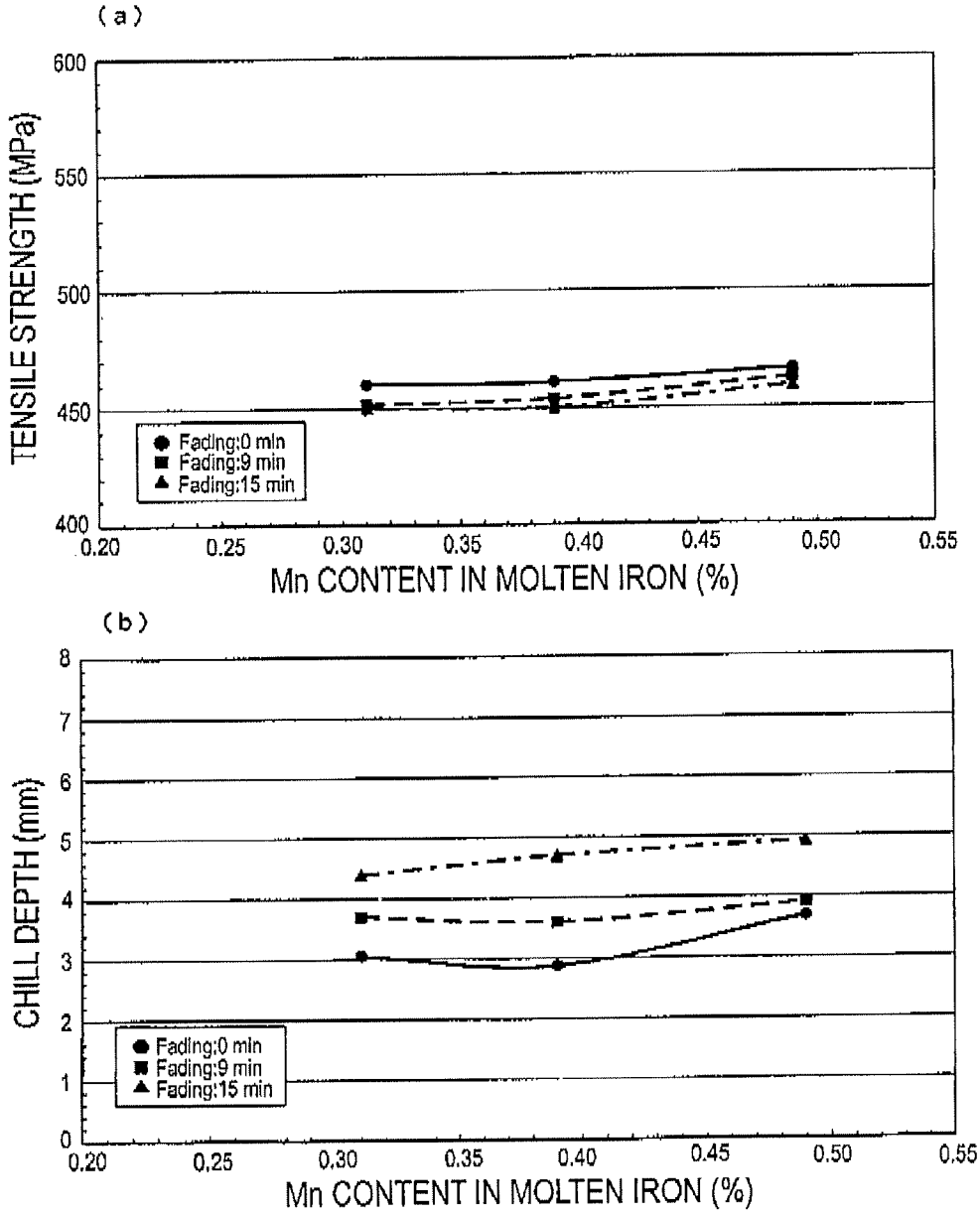
FIG. 3(*a*) and FIG. 3(*b*) are graphs which show changes of properties in relation to the amount of Mn added to a molten iron.

FIG. 3(*a*) and FIG. 3(*b*) show relationships between the amount of Mn added to a molten iron and either the tensile strength (FIG. 3(*a*)) or the chill depth (FIG. 3(*b*)) of the spheroidal graphite cast iron in the case where a spheroidizing agent containing no rare earth was added. Although it is said that Mn is an element accelerating pearlite formation and exerts an important influence on strength, the influence thereof on chill phase formation and on tensile strength was little found in this preliminary test.

Figure 4:
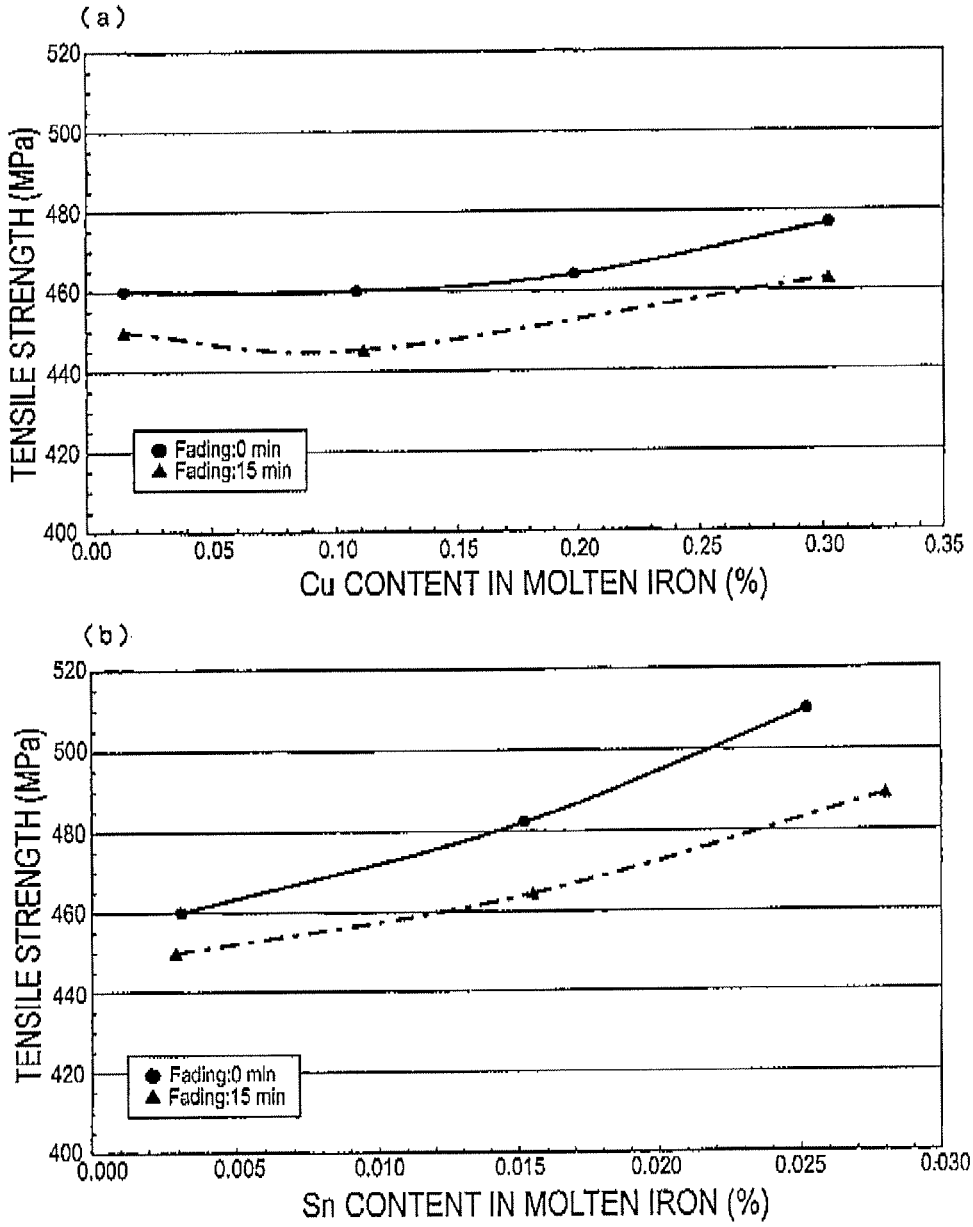
FIG. 4(*a*) and FIG. 4(*b*) are graphs which show relationships between the composition of a molten iron and tensile strength.
Figure 5:
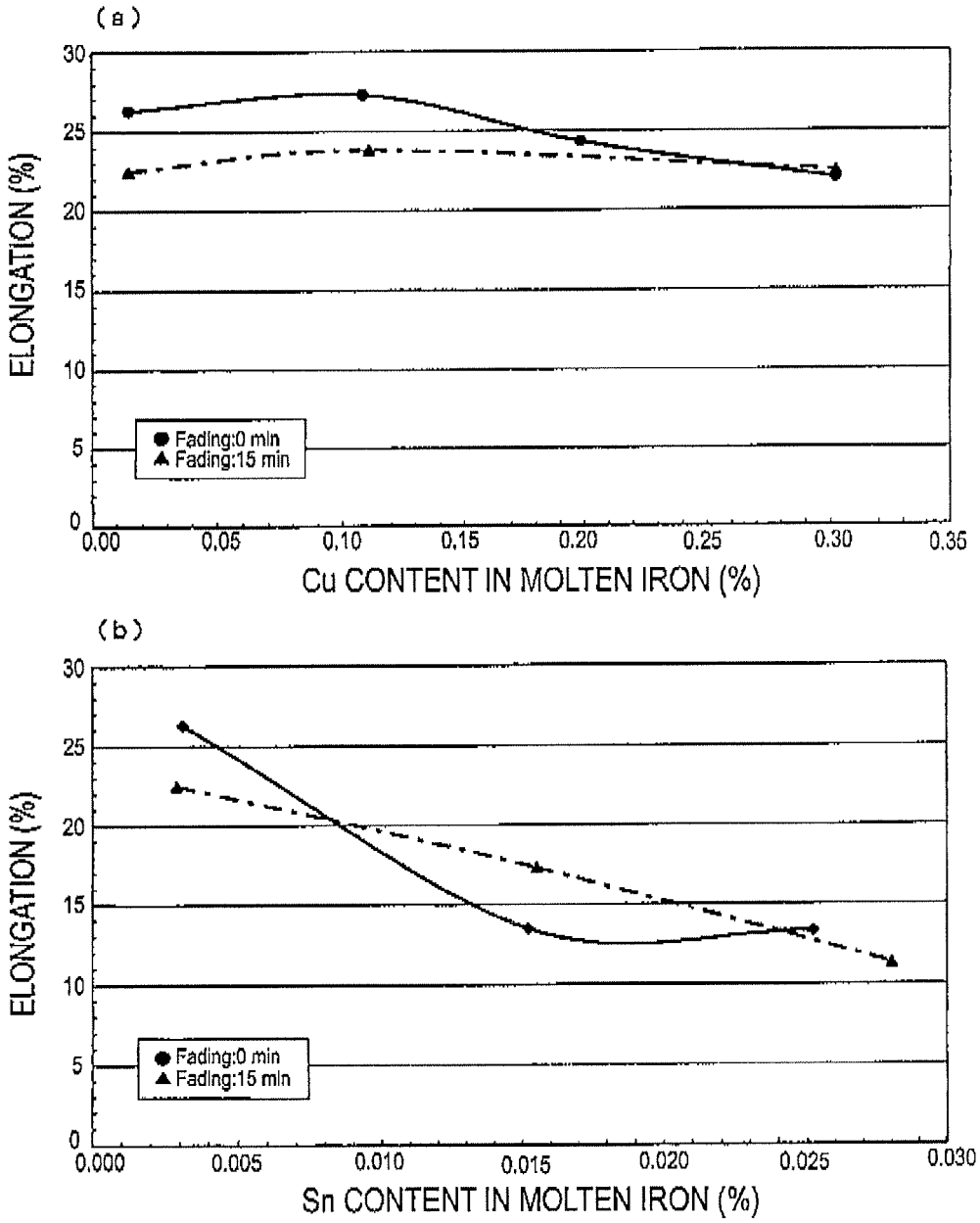
FIG. 5(*a*) and FIG. 5(*b*) are graphs which show relationships between the composition of a molten iron and elongation.

FIG. 4(*a*) to FIG. 5(*b*) show relationships between the amounts of Cu and Sn added to a molten iron and the mechanical properties (tensile strength and elongation) of the spheroidal graphite cast iron in the case where a spheroidizing agent containing no rare earth was used.

In general, both Cu and Sn are considered to have such an effect that as the addition amount thereof increases, the tensile strength improves. In this preliminary test also, it was observed that both elements had the effect of improving strength (see FIG. 4(*a*) and FIG. 4(*b*)). In particular, as the addition amount of Sn increased, the tensile strength improved remarkably.

On the other hand, with respect to elongation, it was confirmed that there is a tendency that the elongation decreased as the addition amount thereof increased in both cases of Cu and Sn, and that the decrease in elongation was smaller in the case of Cu (see FIG. 5(*a*) and FIG. 5(*b*)).

Figure 6:
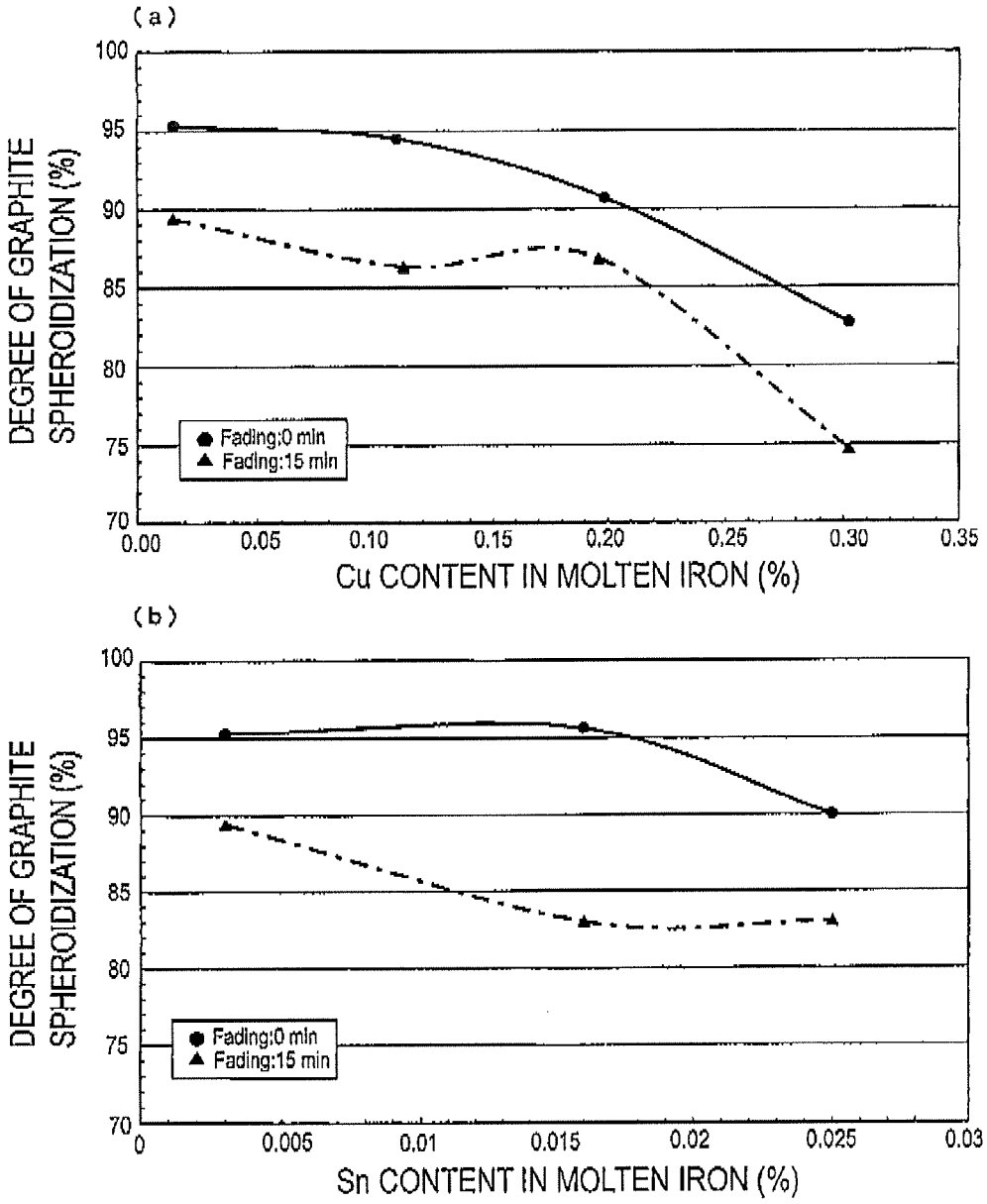
FIG. 6(*a*) and FIG. 6(*b*) are graphs which show relationships between the composition of a molten iron and the degree of graphite spheroidization.

Moreover, Cu and Sn are each elements which inhibit graphite spheroidization, and it was confirmed that the degree of spheroidization decreased as the addition amount of Cu or Sn increased, as shown in FIG. 6(*a*) and FIG. 6(*b*).

It was found through the preliminary test described above that with respect to the addition amounts of Cu and Sn, it is necessary to set the addition amounts while comprehensively taking account of not only the improvement in tensile strength but also influences on properties such as elongation, degree of spheroidization, and tendency to chill phase formation.

Figure 7:
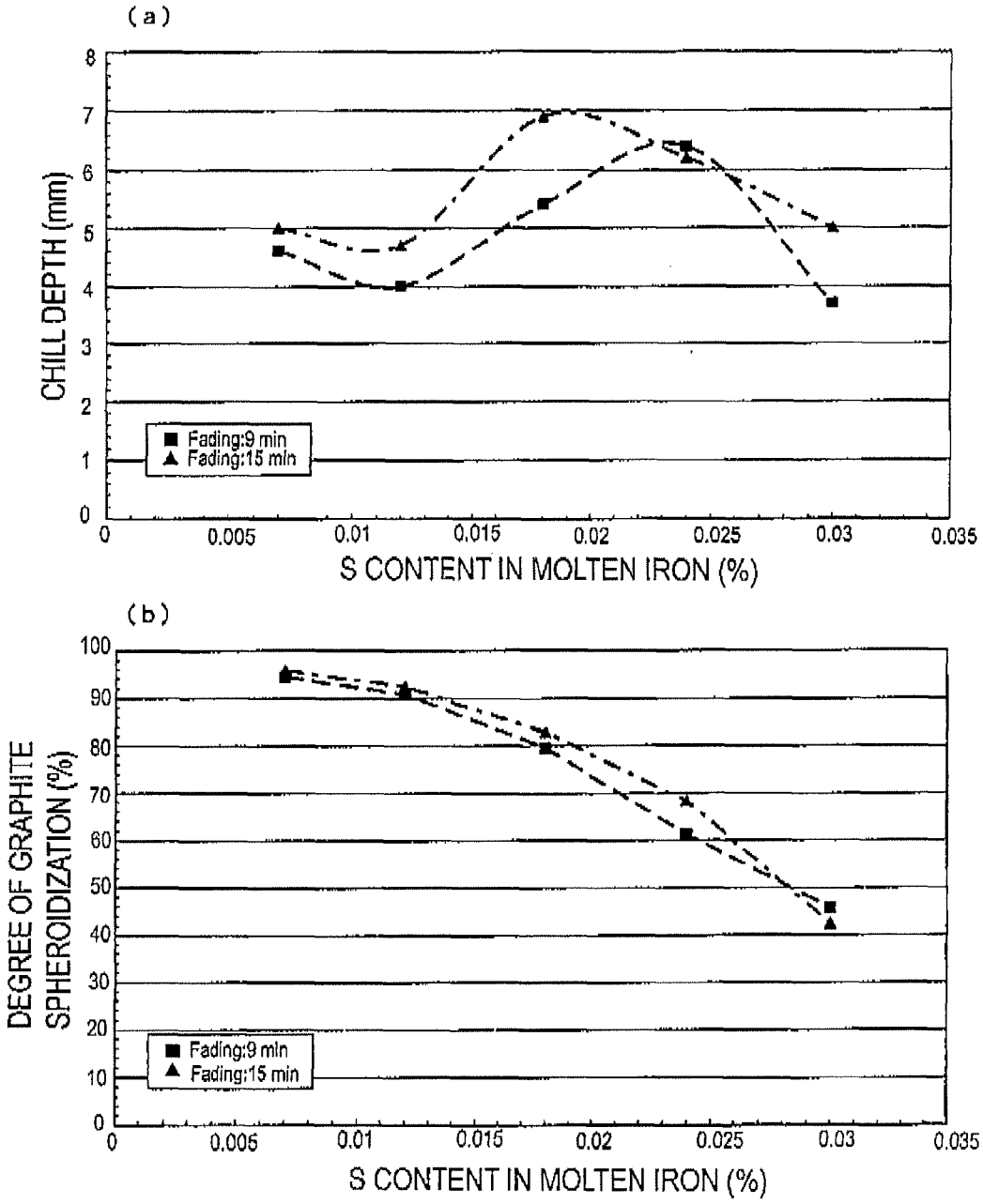
FIG. 7(*a*) and FIG. 7(*b*) are graphs which show changes of properties in relation to the amount of S added to a molten iron.

FIG. 7(*a*) and FIG. 7(*b*) show relationships between the amount of S added to a molten iron and either chill depth or the degree of spheroidization. Since S generally forms sulfides with Mg and Ca to consume these elements, it is thought that S is an impurity which reduces the degree of spheroidization and the effect of inoculation. Because of this, a measure in which the addition amount of S is rendered low by using an electric furnace or selecting scraps is presently being taken. However, there are experimental results which indicate that if the addition amount of S is too low, the effects of inoculation and spheroidization is lessened. Namely, it is necessary to control the addition amount of S so as to be in an optimal range, in order to inhibit chill phase formation without inhibiting the spheroidization of graphite.

From this standpoint, a preliminary test was conducted with respect to addition amounts of S which were optimal in the case of using a spheroidizing agent containing no rare earth. As a result, it was found that from the standpoint of minimizing the chill depth, it is preferred to regulate the addition amount of S to about 0.012% in terms of % by mass (see FIG. 7(*a*)).

The component regulation of Cu and Sn may be accomplished by any of addition in the melting furnace, addition in the ladle, and addition simultaneous with pouring inoculation.

[Influences of Mg Content in Spheroidizing Agent]

Figure 8:
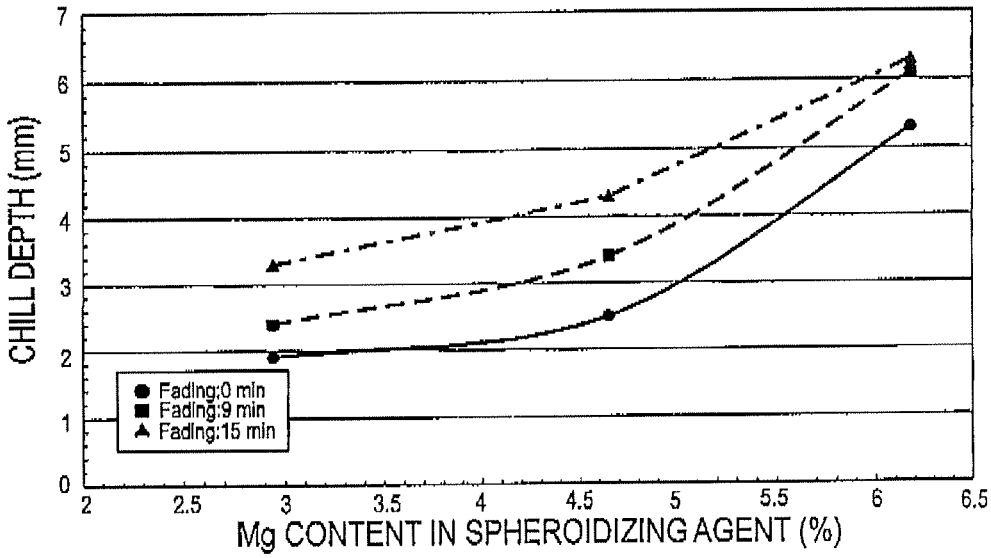
FIG. 8(*a*) and FIG. 8(*b*) are graphs which show changes of properties in relation to the content of Mg in a spheroidizing agent.
Figure 8:
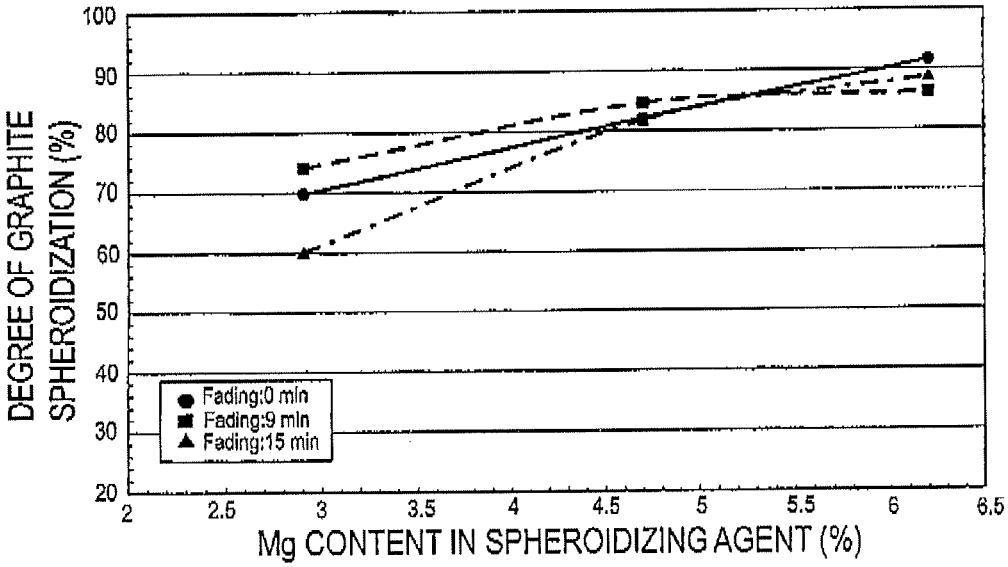

FIG. 8(*a*) and FIG. 8(*b*) show relationships between the content of Mg in a spheroidizing agent and either chill depth or the degree of spheroidization. It is confirmed from FIG. 8(*b*) that Mg, which is a spheroidizing element, is remarkably effective in improving the degree of spheroidization. However, it is simultaneously confirmed from FIG. 8(*a*) that Mg is also an element which enhances the tendency to chill phase formation. It is therefore necessary that a proper range of the content of Mg is necessary to be determined while comprehensively assessing influences thereof on various properties.

[Influences of Ca and Ba Contents in Pouring Inoculant]

Figure 9:
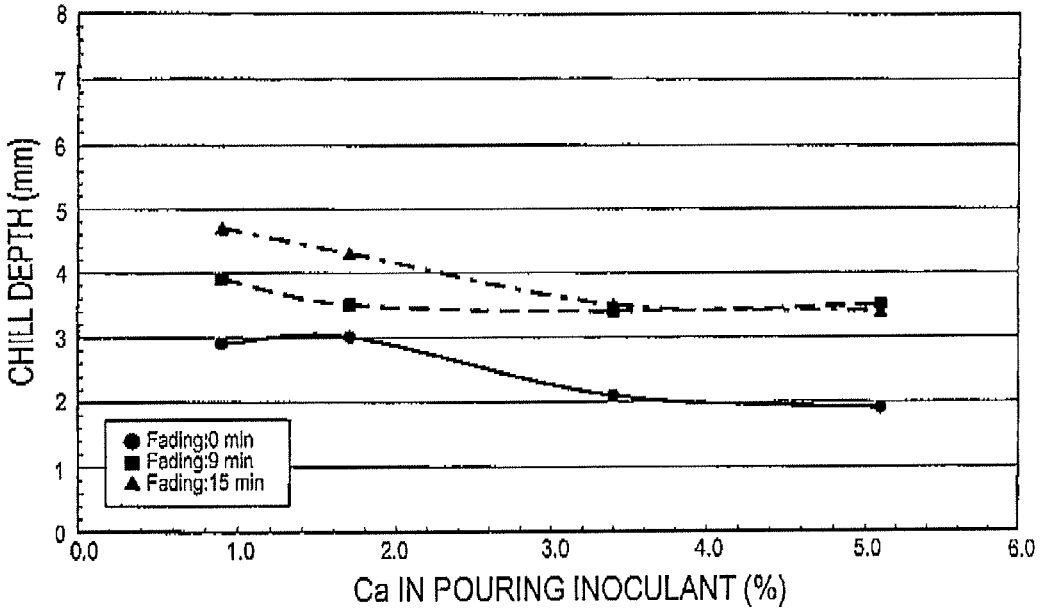
FIG. 9 shows a relationship between the content of Ca in a pouring inoculant and chill depth.

It is confirmed, by reference to FIG. 9, that the effect of inhibiting chill phase formation was gradually enhanced as the content of Ca in a pouring inoculant was increased in a range up to 3%. However, no significant effect was observed at higher contents thereof. So long as the content thereof was in that range, substantially no influence on elongation or on the degree of spheroidization was observed.

Meanwhile, in the case where the content of Ca exceeds 5%, problems such as insufficient dissolution due to endothermic reaction with the molten iron and an increase in percent defective due to an increase in slag arise. Thus, sufficient investigations are hence necessary when a proper range thereof is determined.

Figure 10:
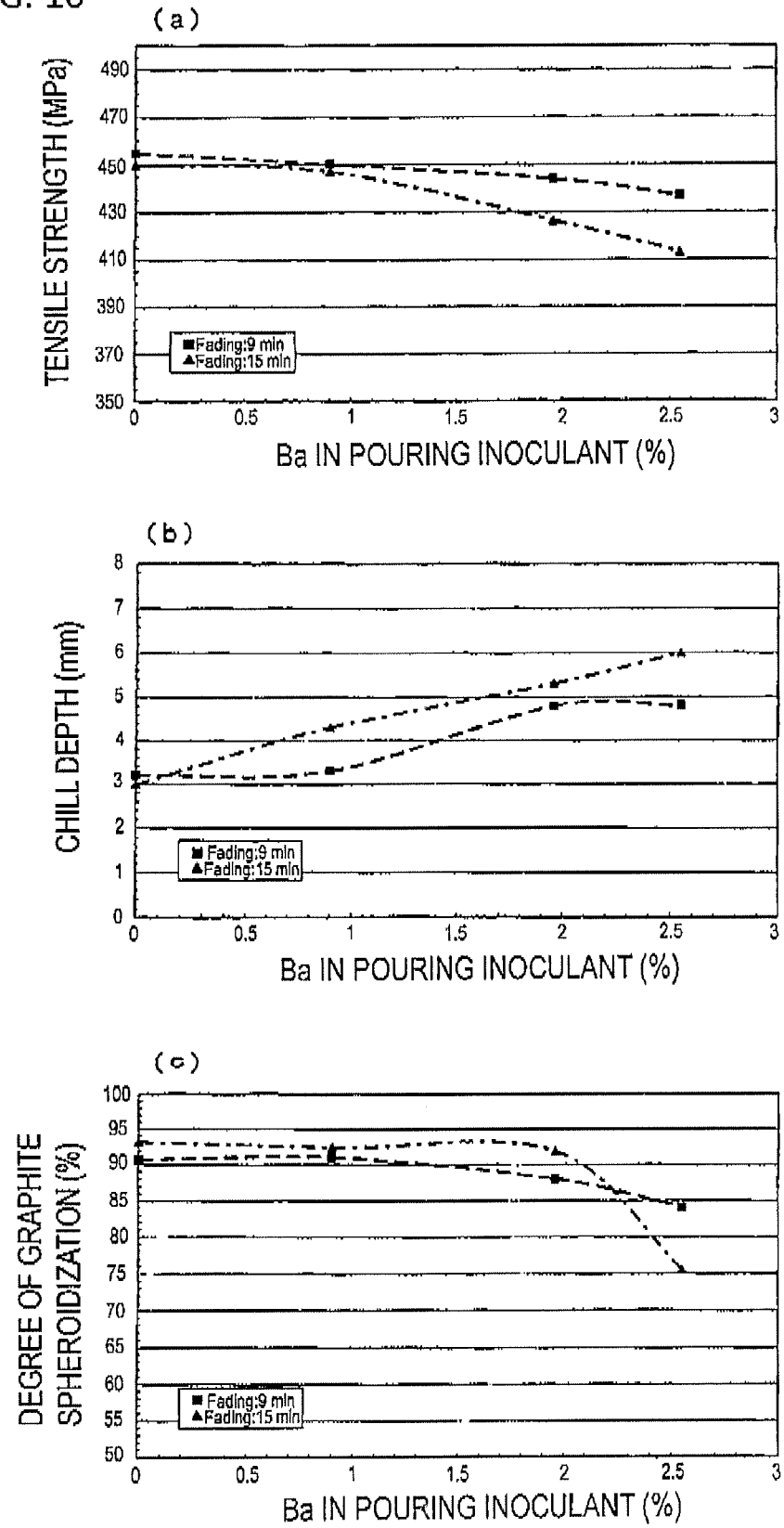
FIG. 10(*a*), FIG. 10(*b*), and FIG. 10(*c*) are graphs which show changes of properties in relation to the content of Ba in a pouring inoculant in the case of using fading times of 9 minutes and 15 minutes.

FIG. 10(*a*) to FIG. 10(*c*) show relationships between the content of Ba in a pouring inoculant and each of tensile strength (FIG. 10(*a*)), chill depth (FIG. 10(*b*)), and the degree of spheroidization (FIG. 10(*c*)) in the case of using fading times of 9 minutes and 15 minutes.

Ba is generally regarded as effective in reducing graphite size because oxides or sulfides thereof in the molten iron constitute graphite nuclei. Ba is hence frequently added as an auxiliary ingredient to inoculants. In the preliminary test, however, it was confirmed that each of the tensile strength, tendency to chill phase formation, degree of spheroidization, and reduction of fading time tended to deteriorate as the addition amount of Ba increased, as shown in FIG. 10(*a*) to FIG. 10(*c*). The effectiveness of the addition of Ba was unable to be ascertained.

[Addition Amount of Pouring Inoculant]

Figure 11:
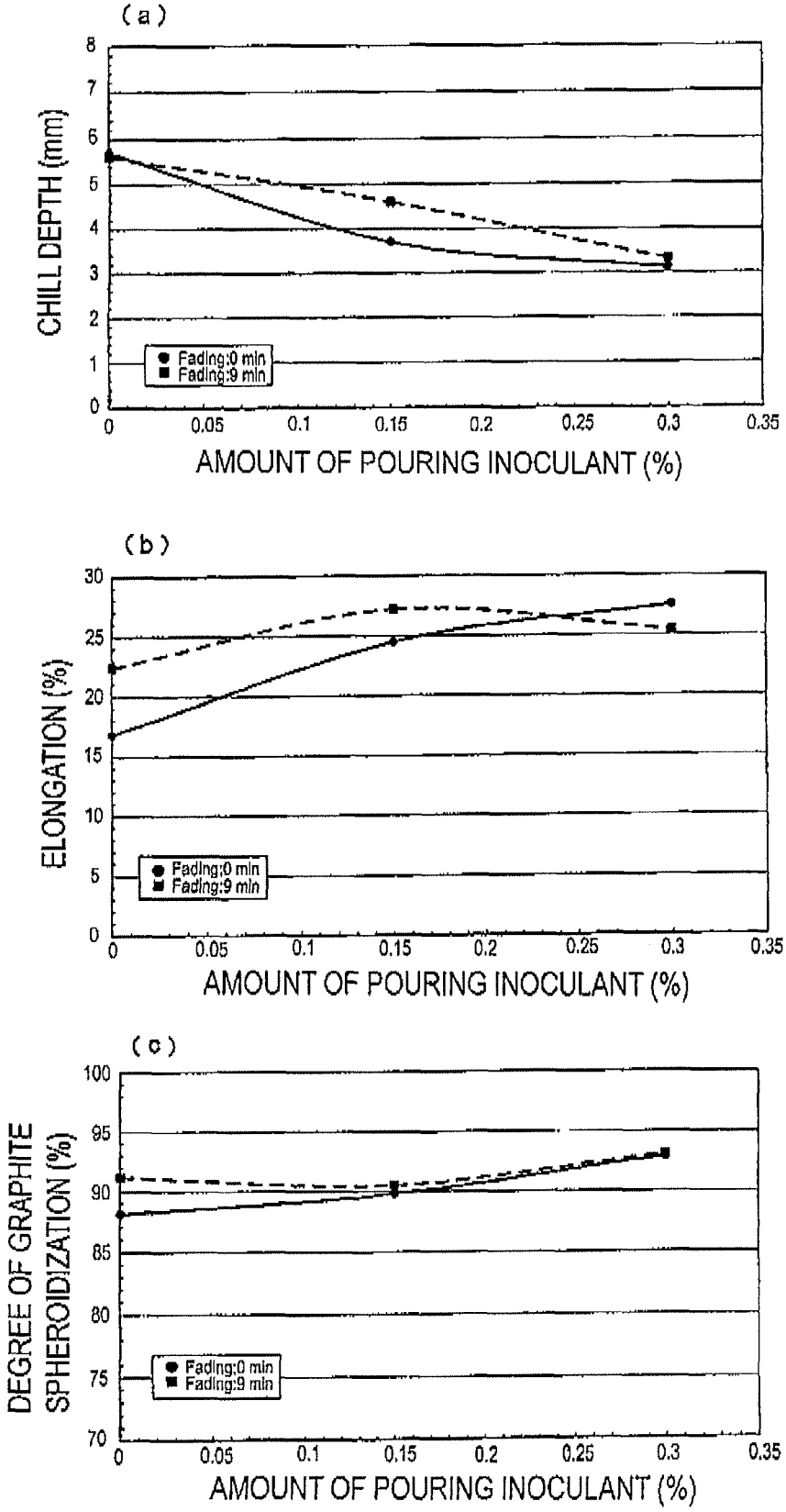
FIG. 11(*a*), FIG. 11(*b*), and FIG. 11(*c*) are graphs which show changes of properties in relation to the addition amount of a pouring inoculant in the case of using fading times of 0 minute and 9 minutes.

FIG. 11(*a*) to FIG. 11(*c*) show relationships between the addition amount of a pouring inoculant, which is within the range according to the present invention, and each of chill depth (FIG. 11(*a*)), elongation (FIG. 11(*b*)), and the degree of spheroidization (FIG. 11(*c*)).

It is confirmed, by reference to these drawings, that as the addition amount of the pouring inoculant increases, not only the tendency to chill phase formation is lessened and the chill depth decreases but also the elongation and the degree of spheroidization improve.

[Fading Time]

Figure 12:
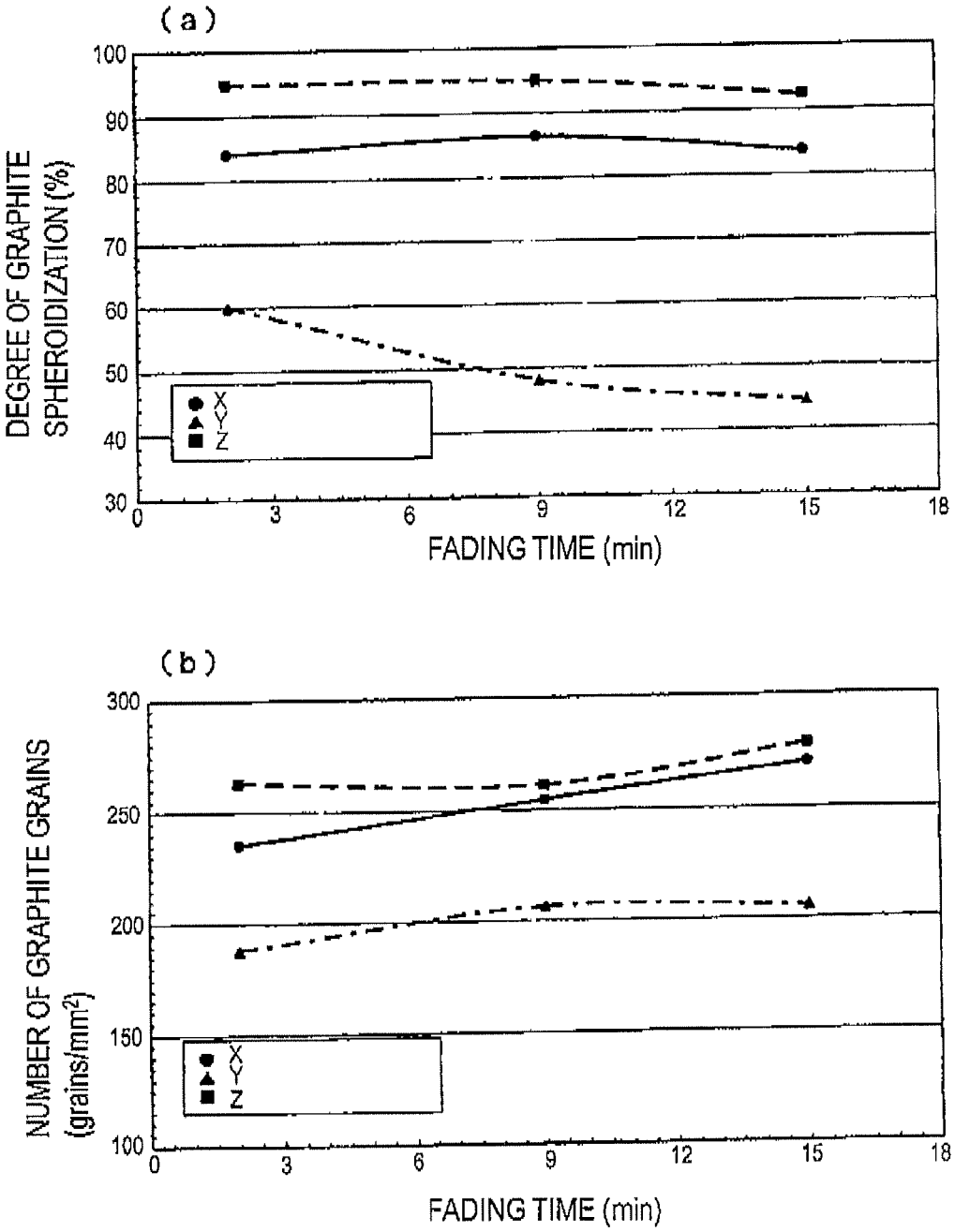
FIG. 12(*a*) and FIG. 12(*b*) are graphs which show relationships between fading time and properties in the case of changing the conditions with respect to the presence or absence of a rare earth in a spheroidizing agent and whether an inoculation treatment is conducted or not.

FIG. 12(*a*) and FIG. 12(*b*) show relationships between fading time and either the degree of spheroidization (FIG. 12(*a*)) or the number of graphite grains (FIG. 12 (*b*)), in the case of changing the conditions with respect to the presence or absence of a rare earth in a spheroidizing agent and whether a pouring inoculation treatment was conducted or not.

It was confirmed from these drawings that fading was inhibited even in the case where no rare earth was contained, by conducting a pouring inoculation treatment.

Besides the preliminary tests described above, investigations were made also on influences of a primary inoculation treatment performed in a ladle after tapping from the melting furnace. As a result, it was confirmed that in the case where an ordinary Fe—Si-based inoculant was used and was added in a normal amount to conduct the treatment, the influences on the tendency to chill phase formation, degree of spheroidization, fading time, etc, are exceedingly slight so long as other step conditions such as, for example, molten iron conditions and spheroidization conditions are constant.

In general, in spheroidal graphite cast iron, the tensile strength and the rigidity (Young's modulus) correlate with the degree of spheroidization. In this preliminary test also, samples having different degrees of spheroidization were produced and influences thereof were confirmed.

Figure 13:
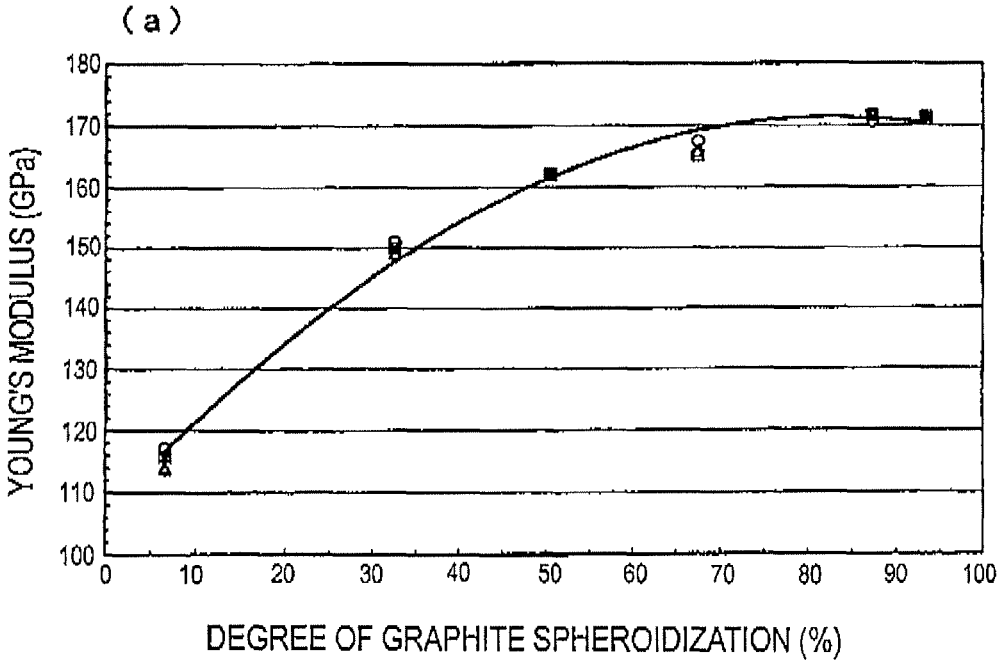
FIG. 13(*a*) and FIG. 13(*b*) are graphs which show relationships between the degree of graphite spheroidization and properties.
Figure 13:
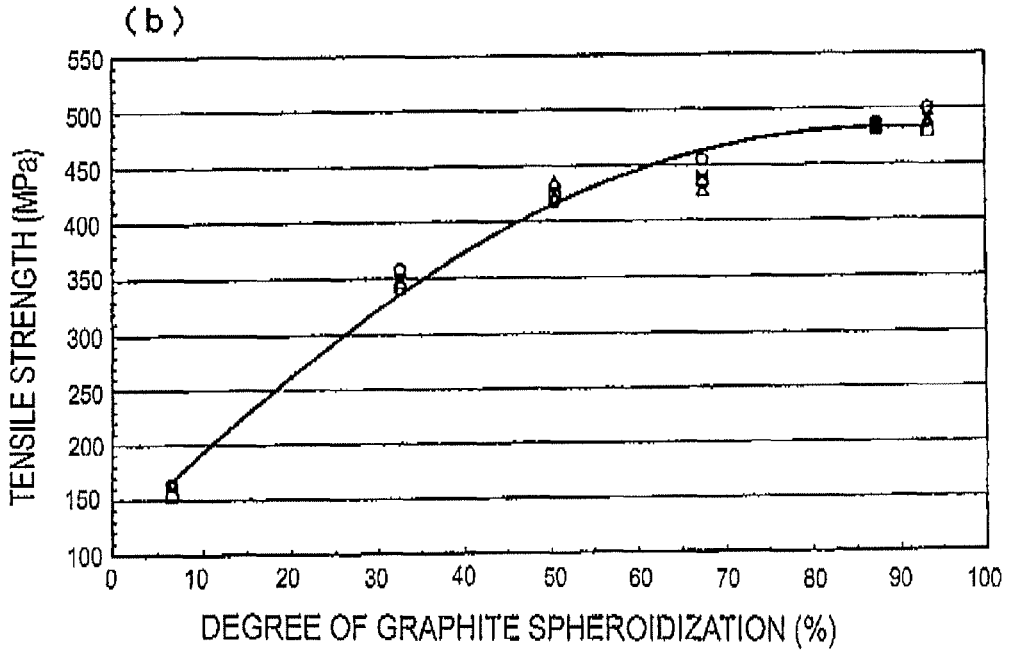

As a result, as shown in FIG. 13(*a*) and FIG. 13(*b*), it was shown that the Young's modulus (FIG. 13(*a*)) and the tensile strength (FIG. 13(*b*)) tended to similarly decrease as the degree of spheroidization decreased. It is therefore understood that components for which it is important to ensure rigidity and tensile strength, such as vehicle components, are required to retain a high level of degree of spheroidization.

Next, the present inventors produced automotive brake calipers using the same apparatus as in a mass-production line, and a confirmatory test in which actual products were produced under conditions that were set while taking account of the results of the preliminary tests was conducted.

As a result, the present inventors have found that a vehicle component which, in the as-cast state or in the state of having been machined in some degree, is excellent in terms of strength/ductility balance, rigidity, machinability, and casting property can be produced even in the case of using a spheroidizing agent containing no rare earth, by simultaneously and accurately controlling the melt components, the amounts of the components of a spheroidizing agent and of an inoculant, and the addition amounts thereof. The present invention has been thus completed.

Specific embodiments of the spheroidal graphite cast iron and production of the vehicle component using this, according to the present invention.

As the raw materials to be used in the present invention, use can be made of scraps of hot-rolled or cold-rolled steel, pig iron, returned cast iron, etc. However, it is preferred to use materials in which the content of impurities such as O, S, and P is low, It is, however, noted that even in the case where the content of these impurities is high, this raw material can be satisfactorily used by reducing the impurity content by conducting a desulfurization treatment or a flux treatment.

The melting furnace is not particularly limited. However, it is preferred to use an electric furnace, in particular, a high-frequency induction furnace. After the raw materials have been melted, C, Si, Mn, S, Cu, and Sn are suitably added thereto to regulate the components of the molten iron. Slag removal from the melting furnace before tapping and from the ladle after a spheroidization treatment is important from the standpoint of removing the slag, e.g., inclusions, which floats on the molten iron surface. It is desirable to conduct the slag removal without fail.

It is preferred that the composition of the molten iron should be regulated so as to contain, in terms of % by mass, 3.0 to 4.5% of C, 2.0 to 3.0% of Si, 0.2 to 0.4 of Mn, 0.006 to 0.020% of S, 0.08 to 0.30% of Cu, and 0.020 to 0.040% of Sn, with the remainder being Fe and unavoidable impurities, from the standpoint of easily regulating the composition of the molten iron to the final composition which will be described later. It is preferred that the molten iron temperature during melting and during component regulation should be regulated to 1,480 to 1,580° C.

Thereafter, the melting furnace is inclined and the molten iron is poured by means of a ladle. In this operation, a spheroidizing agent, a first inoculant, and a covering material are added to conduct a spheroidization treatment and a primary inoculation treatment.

As a method for the spheroidization treatment, use can be made of a sandwich method or another known means. However, a sandwich method is usually employed from the standpoints of the Mg concentration in the spheroidizing agent and the yield of the Mg and because the method does not necessitate any special equipment and is capable of stable graphite spheroidization.

As the spheroidizing agent, use can be made of an Mg-based spheroidizing agent, such as an Fe—Si—Mg-based spheroidizing agent or an Fe—Si—Mg—Ca-based spheroidizing agent, that contains no rare earth. It is preferred to regulate the particle diameter of the spheroidizing agent to about 0.05 to 5 mm, from the standpoints of incomplete dissolution and uniform mixing with the molten iron. The composition and use amount of the spheroidizing agent are suitably determined while taking account of the composition of the molten iron in relation to the final composition.

In the sandwich method, a covering material is placed on the spheroidizing agent and the inoculant in order to prevent the spheroidizing agent and the inoculant from coming into direct contact with the molten iron, from the standpoint of inhibiting reactions from occurring until the level of the molten iron reaches a given position within the ladle. As the covering material, an Fe—Si-based covering material is used.

As the first inoculant to be used in the primary inoculation treatment in the ladle, use can be made of an Fe—Si-based inoculant or Ca—Si-based inoculant. Usually, however, an Fe—Si-based inoculant in which the Si content is 45 to 75% is used. It is preferred to regulate the particle diameter of the inoculant to about 0.05 to 5 mm, from the standpoints of incomplete dissolution and uniform mixing with the molten iron.

The first inoculant to be used in the primary inoculation treatment is disposed in the pocket at the bottom of the ladle together with the spheroidizing agent. The spheroidization treatment and the primary inoculation treatment need not to be conducted simultaneously. The inoculant may be introduced alone into the ladle after the spheroidization treatment. It is, however, preferred that the primary inoculation treatment should be conducted immediately after the spheroidization treatment without delay, from the standpoint of enabling the pouring inoculation, which is conducted just before casting into a casting mold, to sufficiently produce the inoculation effect.

In the present invention, pouring inoculation is thereafter conducted before the molten iron which has undergone the spheroidization treatment and the primary inoculation treatment is cast into a casting mold. As a pouring inoculant, a second Fe—Si-based inoculant is used. Specifically, it is necessary to use the inoculant which contains the following components in terms of % by mass: 45 to 75% of Si, 1 to 3% of Ca, and 15 ppm or less of Ba.

Si is a main element in the inoculant, and the content thereof is regulated to about 45 to 75%, which is a normal amount in the case of using ferrosilicon-based raw materials.

In the case where the content thereof is less than 45%, slag is formed in a larger amount. In the case where the content thereof exceeds 75%, solubility is deteriorated.

Ca has the effects of inhibiting chill phase formation and improving the degree of spheroidization on the basis of the acceleration of matrix graphitization and the acceleration of graphite spheroidization. The content of Ca is necessary to be regulated to 1 to 3%, and is preferably regulated to 1.2 to 2.2%.

In the case where the content thereof is less than 1%, the effects of the inoculation are not produced and graphite size reduction and graphite spheroidization do not proceed. In the case where the content thereof exceeds 3%, the content of CaO, which is hard, increases, resulting in slag formation and poor machinability.

With respect to Ba, each of the properties becomes poorer as the addition amount thereof increases, as apparent from the results of the preliminary experiments described above. It is therefore necessary to minimize the addition amount thereof. The amount thereof is regulated to 15 ppm or less.

The remainder of the second Fe—Si-based inoculant, i.e., the portion other than Si, Ca, and Ba, is constituted of Fe and unavoidable impurities.

The amount of the pouring inoculant to be added, in terms of % by mass based on the molten iron, is necessary to be 0.20 to 0.40%, and is preferably 0.25 to 0.30%, from the standpoints of lessening the tendency to chill phase formation and improving the degree of spheroidization and elongation.

In the case where the addition amount thereof exceeds 0.40%, a larger proportion of the inoculant remains undissolved and slag formation is enhanced. In the case where the addition amount thereof is less than 0.20%, the inoculation does not produce sufficient effects. As a result, not only the desired property improvements cannot be expected but also the yield of the introduced material decreases.

Although the pouring inoculation is conducted just before casting into a casting mold, it is preferred that the inoculant should be introduced at a constant rate and uniformly mixed with the molten iron without fail, by using an automatic supplying apparatus or the like. It is also possible to conduct the inoculation by an in-mold inoculation method in which the inoculant is disposed in the casting mold. In this case, however, it is necessary to sufficiently contrive the design of the mold, etc. so that the second inoculant does not remain undissolved and is uniformly mixed with the molten iron.

In addition, since the pouring inoculation treatment as the final treatment exerts considerable influences, it is necessary that the introduced second inoculant should uniformly mix with the molten iron without fail to produce the effects thereof, for satisfying all of the desired material properties. From these standpoints, it is preferred to regulate the particle diameter of the inoculant to 0.05 to 5 mm.

The spheroidal graphite cast iron thus obtained must have a final composition which contains substantially no rare earth and contains the following components in terms of % by mass: 3.0 to 4.5% of C, 3.0 to 4.5% of Si, 0.2 to 0.4% of Mn, 0.006 to 0.020% of S, 0.08 to 0.30% of Cu, 0.020 to 0.040% of Sn, and 0.015 to 0.050% of Mg, with the remainder being Fe and unavoidable impurities.

Here, the wording "contains substantially no rare-earth element" means that inclusion thereof as unavoidable impurities in an amount of 0.001% or less is permissible although intentional addition is not conducted.

In the final composition of the spheroidal graphite cast iron, the content of C is necessary to be regulated to 3.0 to 4.5%, and is preferably regulated to 3.2 to 4.2%.

In the case where the content thereof is less than 3.0%, not only the spheroidal graphite cast iron has an insufficient graphite content and the tendency to chill phase formation is enhanced, but also the flowability of the molten iron is deteriorated. Meanwhile, in the case where the content thereof exceeds 4.5%, C is in excess and kish graphite is apt to be formed. Consequently, the cast iron material itself is brittle, and given strength cannot be obtained.

The content of Si is necessary to be regulated to 3.0 to 4.5%, and is preferably regulated to 3.2 to 4.2%.

In the case where the content thereof is less than 3.0%, not only the flowability of the molten iron for spheroidal graphite cast iron is deteriorated but also a chill structure is formed in an increased amount and cementite is apt to precipitate in the base structure, making it impossible to obtain the desired elongation. Meanwhile, in the case where the content thereof exceeds 4.5%, the homogeneity of the material is deteriorated and silicoferrite content is increased. This material becomes brittle and elongation is considerably reduced.

Mn is an element which accelerates pearlite formation, and the influence thereof on strength is important. The content of Mn is necessary to be regulated to 0.2 to 0.4%, and is preferably regulated to 0.25 to 0.35%.

In the case where the content thereof is less than 0.2%, the pearlite amount in the microstructure decreases and the ferrite amount increases. Consequently, given strength is not obtained. Meanwhile, in the case where the content thereof exceeds 0.4%, the amount of structures such as cementite and pearlite in the matrix increases and this enhances chill phase formation to exert an adverse influence on machinability.

The content of S is necessary to be regulated to 0.006 to 0.020%, and is preferably regulated to 0.008 to 0.014%.

In the case where the content thereof is less than 0.006%, the effects of the inoculation and spheroidization are lessened. Meanwhile, in the case where the content thereof exceeds 0.020%, the S forms sulfides with Mg and Ca to consume these elements, thereby reducing the degree of spheroidization and the effect of inoculation.

As stated above, Cu and Sn, in one view, are pearlite-forming elements which are added for the purpose of strengthening the matrix to improve the tensile strength, but in another view, are elements which inhibit the spheroidization of graphite. Furthermore, the strength-improving effect of Cu is said to be about 1/10 that of Sn, and the price of Cu is about 1/10 that of Sn.

Consequently, from the standpoint of the effects of the addition on strength improvement, elongation reduction, reduction of the degree of spheroidization, and enhancement of chill phase formation and from the standpoint of profitability, the content of Cu is necessary to be regulated to 0.08 to 0.30%, and is preferably regulated to 0.10 to 0.20%.

Similarly, the content of Sn is necessary to be regulated to 0.02 to 0.040%, and is preferably regulated to 0.025 to 0.035%.

Mg is an element which is added to the spheroidizing agent in order to spheroidize the graphite, and remains after the spheroidization treatment. The content of Mg is necessary to be regulated to 0.015 to 0.050%, and is preferably regulated to 0.035 to 0.045%.

In the case where the content thereof is less than 0.015%, spheroidization of the graphite does not proceed sufficiently and, hence, the desired strength and rigidity are not obtained. Meanwhile, since Mg is an element which is highly susceptible to oxidation, in the case where the content thereof exceeds 0.050%, there is a tendency that it result in increases in the amount of shrinkage cavities and in Mg oxide content in the matrix to reduce the strength. Furthermore, a chill phase is prone to be formed, resulting in impaired machinability, as stated above.

Next, an explanation is given on the case where the spheroidal graphite cast iron obtained by the production method of the present invention is applied to a component for vehicles, such as an automotive brake member.

The spheroidal graphite cast iron obtained by the production method of the present invention can be applied regardless of the thickness or size of a product. In the following explanation, however, the case where the spheroidal graphite cast iron is applied to an automotive brake caliper having a thickness of about 3 to 40 mm on the supposition of use in general passenger cars or commercial cars is explained as an example.

The strength levels required of automotive brake caliper components vary depending on uses thereof. However, the present invention is suitable especially for calipers as provided for in JIS FCD400-FCD500.

First, it is necessary that after the pouring inoculation treatment described above, the molten iron obtained is necessary to be cast into a casting mold (sand mold). It is preferred that the casting temperature in this operation should be 1,300 to 1,450° C. From the standpoint of avoiding the influence of fading effect, it is preferred that the period from the spheroidization treatment to the casting should be 15 minutes or less. It is more preferred to conduct the casting for 12 minutes or less without delay.

After the casting, cooling is sufficiently conducted until the temperature thereof declines to or below the eutectoid transformation point. Thereafter, the mold is disassembled. The automotive brake caliper obtained by the present invention is intended to be used in such a manner that the gate and the riser are removed therefrom and the resultant cast iron is used as cast, without being subjected to a heat treatment or the like. In this case, however, it is necessary that the period from the casting to the mold disassembly should be kept constant from the standpoint of keeping the dimensional accuracy, structure, hardness, etc, constant.

Although it is necessary to thereafter conduct simple machining such as drilling and surface cutting, the presence of abnormal structures, in particular, a chill phase, in the microstructure considerably affects the cuttability during the machining.

The matrix of the finally obtained spheroidal graphite cast iron according to the present invention is a mixed structure constituted of pearlite and ferrite. The proportion of the pearlite in the matrix (excluding graphite portions) is generally 30 to 60% in terms of areal proportion. This spheroidal graphite cast iron has a tensile strength of 450 MPa or higher, an elongation of 12% or higher, and a degree of spheroidization of 80% or higher. Even when a product including this spheroidal graphite cast iron is produced so as to have a thin-wall part having a thickness of 6 mm or less, the chill area rate thereof can be regulated to 1% or less. This product is hence preferred.

EXAMPLES

The present invention will be explained below in more detail by reference to Examples in which the thin-wall spheroidal graphite cast iron in an as-cast state according to the present invention was used to produce an automotive brake caliper. However, the present invention should not be construed as being limited to the following Examples.

For the spheroidal graphite cast iron of the Examples (Examples 1 to 13 and Comparative Examples 1 to 8), a returned cast iron material and a scrap iron material were used as raw materials. The ratio of the returned material to the scrap iron material in the raw materials was about 1:1. The raw materials were melted using a high-frequency melting furnace. Thereafter, C, Si, Mn, S, Cu, and Sn were suitably added thereto as additive elements to regulate the molten iron so that the molten iron contained the components corresponding to FCD450 (JIS G 5502), i.e., the molten iron had a composition containing, in terms of % by mass, 3.0 to 4.5% of C, 2.0 to 3.0% of Si, 0.2 to 0.4% of Mn, 0.006 to 0.020% of S, 0.08 to 0.30% of Cu, and 0.020 to 0.040% of Sn, with the remainder being Fe and unavoidable impurities. Thereafter, the molten iron was tapped and introduced into a ladle while regulating the tapping temperature to 1,500° C.

Prior to the tapping, an Fe—Si—Mg—Ca-based spheroidizing agent for the molten iron to be poured was placed in the pocket at the bottom of the ladle and an Fe—Si-based covering material was placed thereon in an amount of 0.45% based on the molten iron to be poured. Thus, a spheroidization treatment was conducted by a sandwich method. Thereafter, slag-off was conducted. The molten iron which had undergone the treatment was introduced into a small ladle, during which a primary inoculation treatment was conducted by an in-ladle inoculation method. Thereafter, slag-off was performed. As the primary inoculant, an Fe—Si-based alloy inoculant which is ordinarily used was used. Furthermore, just before the molten iron which had undergone the primary inoculation treatment was cast into a sand mold, a pouring inoculation treatment with a second Fe—Si-based inoculant was conducted by means of an automatic injection device. Thus, spheroidal graphite cast iron (Examples 1 to 13 and Comparative Examples 1 to 8) was obtained.

Table 1 shows the composition (% by mass) of the spheroidal graphite cast iron of each of Examples 1 to 13 and Comparative Examples 1 to 8 and the number of the inoculant used therefor. In Table 1, the proportion of the Fe and unavoidable impurities which constituted the remainder is omitted. In Table 1, RE represents rare earth.

Table 2 shows the compositions (% by mass) of Si, Ca, and Ba in each pouring inoculant used, which is shown in Table 1, and the addition amount thereof. The remainder of the pouring inoculant is Fe and unavoidable impurities. Pouring inoculants Nos. 1 to 5 are inoculants in which the composition and the addition amount are within the ranges according to the present invention; pouring inoculant No. 6 is an inoculant in which the addition amount is outside the range according to the present invention; and pouring inoculants Nos. 7 and 8 are inoculants in which the composition is outside the range according to the present invention.

TABLE 1

| | C | Si (molten iron/ product) | Mn | S | Cu | Sn | Mg | RE (ppm) | Pouring inoculant No. |
|---|---|---|---|---|---|---|---|---|---|
| Example 1 | 3.5 | 2.6/3.6 | 0.31 | 0.012 | 0.12 | 0.025 | 0.038 | 8 | 1 |
| Example 2 | 3.5 | 2.7/3.6 | 0.32 | 0.012 | 0.12 | 0.025 | 0.050 | 6 | 1 |
| Example 3 | 3.6 | 2.6/3.6 | 0.32 | 0.006 | 0.13 | 0.025 | 0.041 | 5 | 1 |
| Example 4 | 3.6 | 2.7/3.7 | 0.28 | 0.020 | 0.12 | 0.024 | 0.040 | 10 | I |
| Example 5 | 3.5 | 2.6/3.5 | 0.29 | 0.013 | 0.08 | 0.030 | 0.042 | 7 | 1 |
| Example 6 | 3.6 | 2.7/3.6 | 0.32 | 0.011 | 0.30 | 0.025 | 0.039 | 6 | 1 |
| Example 7 | 3.4 | 2.7/3.7 | 0.32 | 0.012 | 0.13 | 0.020 | 0.041 | 5 | 1 |
| Example 8 | 3.6 | 2.8/3.7 | 0.33 | 0.012 | 0.12 | 0.040 | 0.042 | 8 | 1 |
| Example 9 | 3.6 | 2.6/3.6 | 0.28 | 0.012 | 0.15 | 0.025 | 0.015 | 7 | 1 |
| Example 10 | 3.5 | 2.7/3.6 | 0.31 | 0.012 | 0.12 | 0.024 | 0.042 | 7 | 2 |
| Example 11 | 3.6 | 2.6/3.5 | 0.32 | 0.012 | 0.13 | 0.024 | 0.041 | 9 | 3 |
| Example 12 | 3.6 | 2.6/3.6 | 0.30 | 0.012 | 0.12 | 0.024 | 0.042 | 8 | 4 |
| Example 13 | 3.6 | 2.6/3.6 | 0.31 | 0.012 | 0.12 | 0.025 | 0.041 | 4 | 5 |
| Comparative Example 1 | 3.6 | 2.6/3.7 | 0.29 | 0.005 | 0.12 | 0.025 | 0.060 | 6 | 1 |
| Comparative Example 2 | 3.6 | 2.6/3.6 | 0.30 | 0.010 | 0.40 | 0.010 | 0.040 | 6 | 1 |
| Comparative Example 3 | 3.5 | 2.7/3.7 | 0.33 | 0.030 | 0.12 | 0.030 | 0.040 | 5 | 1 |
| Comparative Example 4 | 3.5 | 2.6/3.7 | 0.32 | 0.012 | 0.05 | 0.025 | 0.041 | 5 | 1 |
| Comparative Example 5 | 3.5 | 2.7/3.6 | 0.31 | 0.012 | 0.12 | 0.025 | 0.012 | 6 | 1 |
| Comparative Example 6 | 3.5 | 2.6/3.7 | 0.31 | 0.012 | 0.12 | 0.025 | 0.038 | 8 | 6 |
| Comparative Example 7 | 3.5 | 2.6/3.6 | 0.31 | 0.012 | 0.12 | 0.025 | 0.038 | 8 | 7 |
| Comparative Example 8 | 3.5 | 2.6/3.5 | 0.31 | 0.012 | 0.12 | 0.025 | 0.038 | 8 | 8 |

TABLE 2

| Pouring inoculant No. | Si (%) | Ca (%) | Ba (%) | Addition amount (%) |
|---|---|---|---|---|
| 1 | 75 | 1.50 | <0.001 | 0.28 |
| 2 | 75 | 1.51 | <0.001 | 0.40 |
| 3 | 75 | 1.50 | <0.001 | 0.20 |
| 4 | 75 | 1.00 | <0.001 | 0.28 |
| 5 | 75 | 3.00 | <0.001 | 0.28 |
| 6 | 75 | 1.51 | <0.001 | 0.10 |
| 7 | 75 | 4.02 | <0.001 | 0.28 |
| 8 | 76 | 1.51 | 1.00 | 0.28 |

The spheroidal graphite cast iron obtained was cast into a sand mold having a thin-wall part and then sufficiently cooled until the temperature thereof declined to or below the eutectoid transformation point, and the mold was disassembled. In each Example, the period from the spheroidization treatment to the casting was within 12 minutes. Thereafter, ordinary finishing treatment, such as shot blasting and gate, dam, and burr removal, was conducted.

A tensile test specimen (overall length, 60 mm) was cut out of each automotive brake caliper obtained, and this test specimen was subjected to a tensile test at ordinary temperature to evaluate the tensile properties and was further evaluated for rigidity (Young's modulus) by a free oscillation method. Moreover, test specimens were cut out from different portions of each product and examined for the degree of spheroidization and Rockwell hardness. Furthermore, test specimens were cut out also from the thin-wall parts, which were prone to have undergone chill phase formation, and the structure near the surface layer was observed to determine the presence or absence of a chill phase. In addition, an appearance inspection, a macroscopic inspection of cross-sections, a PT inspection, and the like were performed in order to evaluate each product for internal defects. The measuring conditions for the various evaluations were in accordance with the following JIS standards.

Tensile test: JIS Z 2241

Young's modulus test: JIS Z 2280

Test for degree of spheroidization: JIS G5502

Rockwell hardness test: JIS Z 2245

With respect to chill phase, the case where the chill area rate exceeded 1% was rated as "present", and the case where the chill area rate was less than 1% was rated as "absent". With respect to internal defects, the case where a defect of 2 mm or larger was observed in the macroscopic inspection of cross-sections was rated as "present", and the other cases were rated as "absent".

The results of the evaluation are shown in Table 3. The values of the properties of a current product for which a spheroidizing agent containing a rare earth was used are shown in the table for reference.

| | Tensile strength (MPa) | Young's modulus (GPa) | Elongation (%) | Degree of spheroidization (%) | Hardness (HRB) | Chill phase | Internal defect |
|---|---|---|---|---|---|---|---|
| Example 1 | 514 | 176 | 18 | 92 | 84 | absent | absent |
| Example 2 | 535 | 188 | 18 | 90 | 85 | absent | absent |
| Example 3 | 520 | 180 | 16 | 93 | 83 | absent | absent |
| Example 4 | 525 | 178 | 14 | 88 | 84 | absent | absent |
| Example 5 | 530 | 175 | 15 | 91 | 85 | absent | absent |

-continued

| | Tensile strength (MPa) | Young's modulus (GPa) | Elongation (%) | Degree of spheroidization (%) | Hardness (HRB) | Chill phase | Internal defect |
|---|---|---|---|---|---|---|---|
| Example 6 | 515 | 178 | 17 | 87 | 83 | absent | absent |
| Example 7 | 512 | 181 | 18 | 94 | 83 | absent | absent |
| Example 8 | 545 | 180 | 13 | 89 | 87 | absent | absent |
| Example 9 | 510 | 171 | 14 | 88 | 82 | absent | absent |
| Example 10 | 520 | 185 | 22 | 92 | 83 | absent | absent |
| Example 11 | 522 | 182 | 18 | 89 | 86 | absent | absent |
| Example 12 | 516 | 178 | 20 | 91 | 84 | absent | absent |
| Example 13 | 512 | 178 | 19 | 93 | 81 | absent | absent |
| Comparative Example 1 | 410 | 161 | 6 | 82 | 78 | absent | present |
| Comparative Example 2 | 473 | 151 | 7 | 74 | 79 | absent | absent |
| Comparative Example 3 | 426 | 170 | 6 | 69 | 85 | present | present |
| Comparative Example 4 | 420 | 172 | 13 | 81 | 88 | present | absent |
| Comparative Example 5 | 423 | 154 | 14 | 65 | 84 | present | present |
| Comparative Example 6 | 442 | 172 | 7 | 71 | 85 | present | absent |
| Comparative Example 7 | 460 | 175 | 12 | 75 | 83 | present | present |
| Comparative Example 8 | 443 | 170 | 8 | 70 | 78 | present | absent |
| Current product (representative value) | 510 | 170 | 13 | 88 | 85 | absent | absent |

As shown in Table 3, Examples 1 to 13 according to the present invention were equal or superior to the current product in each of the properties.

The cases of Examples 3 and 4 differed in S content in the molten iron, the cases of Examples 5 and 6 differed in Cu content therein, and the cases of Examples 7 and 8 differed in Sn content therein, respectively within the ranges according to the present invention. These Examples gave values of tensile strength, elongation, Young's modulus (rigidity), and hardness which are equal to or higher than those of the current product. Furthermore, a chill phase was not observed in the thin-wall parts thereof, and no internal defects had been formed. These cases as automotive brake caliper components showed excellent properties.

The cases of Examples 2 and 9 differed in Mg content in the spheroidizing agent. The degree of spheroidization and internal defects thereof were not problematic, and the values of the other properties thereof also are equal to or higher than those of the current product.

The cases of Examples 10 to 13 differed in Ca content in the pouring inoculant and the addition amount thereof. These cases were satisfactory in terms of each of tensile strength, degree of spheroidization, and tendency to chill phase formation, and were confirmed to be not problematic when used as automotive brake caliper components.

Meanwhile, the case of Comparative Example 1 was problematic with respect to tensile strength and elongation and had internal defects, because the Mg content in the spheroidizing agent was too high. The case of Comparative Example 2 was considerably reduced in the degree of spheroidization and elongation because the amount of Cu added to the molten iron was too large. The case of Comparative Example 3 had suffered chill phase formation and was insufficient in each of tensile strength, elongation, and the degree of spheroidization, because the content of S in the molten iron was too high. The case of Comparative Example 4 had a considerably reduced tensile strength because the amount of Cu added for strength improvement was too small. The case of Comparative Example 5 was reduced in the degree of spheroidization and in tensile strength and Young's modulus because the content of Mg in the spheroidizing agent was too low. The case of Comparative Example 6 had suffered chill phase formation and was insufficient in the degree of spheroidization and elongation, because the addition amount of the pouring inoculant was too small. The case of Comparative Example 7 had internal defects and a reduced elongation because the content of Ca in the pouring inoculant was too high. The case of Comparative Example 8 had undergone enhanced chill phase formation and was reduced in both the degree of spheroidization and tensile strength, because Ba was added to the pouring inoculant. As described above, it was confirmed that the spheroidal graphite cast iron produced by methods which are outside the scope of the present invention had a problem concerning at least one of those properties.

While the present invention has been described in detail and with reference to specific embodiments thereof, it will be apparent to one skilled in the art that various changes and modifications can be made therein without departing from the spirit and scope thereof.

This application is based on a Japanese patent application No. 2011-223483 filed on Oct. 7, 2011, the contents of which are incorporated herein by reference.

The invention claimed is:

1. A method for producing spheroidal graphite cast iron containing substantially no rare-earth element, the method comprising:

(a) a step of subjecting, in a ladle, a molten iron to a spheroidization treatment utilizing a spheroidizing agent of an Fe—Si—Mg-based alloy containing no rare-earth element or Fe—Si—Mg—Ca-based alloy containing no rare-earth element;

(b) a step of conducting an inoculation treatment utilizing a first Fe—Si-based inoculant, either simultaneously with the step (a) or after the step (a); and (c) a step of adding a second Fe—Si-based inoculant to the molten iron in an amount of 0.20 to 0.40% in terms of % by mass after the step (b) to conduct a pouring inoculation treatment, the second Fe—Si-based inoculant containing, in terms of % by mass, 45 to 75% of Si, 1 to 3% of Ca, and 15 ppm or less of Ba, wherein the spheroidal graphite cast iron to be obtained has a composition which contains, in terms of % by mass, 3.0 to 4.5% of C, 3.0 to 4.5% of Si, 0.2 to 0.4% of Mn, 0.006 to 0.020% of S, 0.08 to 0.30% of Cu, 0.020 to 0.040% of Sn, and 0.015 to 0.050% of Mg, with the remainder being Fe and unavoidable impurities.

2. The method for producing spheroidal graphite cast iron according to claim 1, wherein the molten iron has a composition which contains, in terms of % by mass, 3.0 to 4.5% of C, 2.0 to 3.0% of Si, 0.2 to 0.4% of Mn, 0.006 to 0.020% of S, 0.08 to 0.30% of Cu, and 0.020 to 0.040% of Sn, with the remainder being Fe and unavoidable impurities.

3. A vehicle component comprising spheroidal graphite cast iron obtained by the production method according to claim 1, the vehicle component having a degree of graphite spheroidization of 80% or higher, a tensile strength of 450 MPa or higher, and an elongation of 12% or higher, wherein a chill area rate is 1% or less in a thin-wall part in which the vehicle component comprising the spheroidal graphite cast iron has a thickness of 6 mm or less.

4. A vehicle component comprising spheroidal graphite cast iron obtained by the production method according to claim 2, the vehicle component having a degree of graphite spheroidization of 80% or higher, a tensile strength of 450 MPa or higher, and an elongation of 12% or higher, wherein a chill area rate is 1% or less in a thin-wall part in which the vehicle component comprising the spheroidal graphite cast iron has a thickness of 6 mm or less.

* * * * *